US008057647B2

(12) United States Patent
Asou et al.

(10) Patent No.: US 8,057,647 B2
(45) Date of Patent: Nov. 15, 2011

(54) ELECTRODE MOUNTING STRUCTURE OF SURFACE TREATMENT APPARATUS

(75) Inventors: Tomohiro Asou, Hamamatsu (JP); Seiya Kunioka, Hamamatsu (JP); Hitoshi Muramatsu, Hamamatsu (JP); Nobuyuki Suzuki, Toyohashi (JP); Akira Ishibashi, Hamamatsu (JP); Makoto Kawai, Shizuoka-Ken (JP)

(73) Assignee: Suzuki Motor Corporation, Hamamatsu-shi, Shizuoka-ken (JP)

( * ) Notice: Subject to any disclaimer, the term of this patent is extended or adjusted under 35 U.S.C. 154(b) by 246 days.

(21) Appl. No.: 12/490,034

(22) Filed: Jun. 23, 2009

(65) Prior Publication Data

US 2009/0321253 A1 Dec. 31, 2009

(30) Foreign Application Priority Data

Jun. 25, 2008 (JP) ..... 2008-165983

(51) Int. Cl.
*C25B 9/02* (2006.01)
*C25C 7/02* (2006.01)
*C25D 17/06* (2006.01)

(52) U.S. Cl. ..... 204/297.15; 204/288.4; 204/297.01; 204/297.14; 204/286.1

(58) Field of Classification Search ..... 204/297.13, 204/279, 286.1, 288, 288.4, 288.5, 297.01, 204/297.15, 297.14
See application file for complete search history.

(56) References Cited

U.S. PATENT DOCUMENTS 3,671,416 A * 6/1972 Belke ..... 204/297.13

FOREIGN PATENT DOCUMENTS

JP 7-305198 A 11/1995
JP 2006-2204 1/2006

* cited by examiner

*Primary Examiner* — Bruce Bell
(74) *Attorney, Agent, or Firm* — Barnes & Thornburg LLP

(57) ABSTRACT

An electrode mounting structure of a surface treatment apparatus in which a metal electrode is disposed so as to oppose to an inner-peripheral surface of a cylinder, the electrode and the cylinder are energized in a state where treatment liquid is interposed between the electrode and the cylinder inner-peripheral surface so as to perform pre-plating or plating to the cylinder inner-peripheral surface, and the metal electrode is detachably attached to a metal electrode holder member. The structure includes a resin coupler having a threaded portion engaged with a threaded portion formed on the electrode holder member.

8 Claims, 7 Drawing Sheets

ELECTRODE MOUNTING STRUCTURE OF SURFACE TREATMENT APPARATUS

CROSS-REFERENCE TO RELATED APPLICATIONS

This application is a Non-Provisional U.S. Patent Application based upon and claiming the benefit of priority to Japanese Patent Application No. 2008-165983, filed on Jun. 25, 2009, the contents of which are incorporated herein by reference.

BACKGROUND OF THE INVENTION

1. Field of the Invention

The present invention relates to an electrode mounting structure of a surface treatment apparatus for pre-plating or plating a surface of an object to be treated of an object, especially, a cylinder inner-peripheral surface of a cylinder of an engine.

2. Description of the Related Art

In a surface treatment apparatus for pre-plating or plating a cylinder inner-peripheral surface of a cylinder, it is necessary to periodically perform maintenance for an electrode to clean it or to renew masking thereof. Because of this reason, the electrode can be attached to or detached from an electrode holder member.

In an electrode mounting structure of a conventional surface treatment apparatus disclosed in Japanese Patent Application Laid-open No. 7-305198 (Patent Publication 1), as shown in FIG. 7, an electrode 101 and an electrode holder member 102 are formed with threaded portions 103 and 104, respectively, so as to be engaged with each other. Furthermore, Japanese Patent Application Laid-open No. 2006-2204 (Patent Publication 2) discloses a structure shown in FIG. 8 in which a bolt 105 penetrating an electrode holder member 102 is screw-engaged with a threaded portion 106 of an electrode 101, and the electrode 101 is mounted on an electrode holder member 102. In FIGS. 7 and 8, cylinders 100 are objects to be treated.

According to the electrode mounting structures described in the Patent Publications 1 and 2, however, since materials of the threaded portions (threaded portions 103 and 104 or bolt 105 and the threaded portion 106) are both composed of metals, a spark may be caused at the threaded portions, and adhesion may be caused at this threaded portion. Therefore, it becomes difficult to detach the electrode 101, and the maintenance performance of the electrode 101 becomes deteriorated.

This tendency appears seriously for a circulating plating apparatus in which circulation liquid is circulated between the electrode 101 and a cylinder inner-peripheral surface of the cylinder 100 because density of current flowing through the electrode 101 and the cylinder 100 is greater than that of an immersion-type plating apparatus.

SUMMARY OF THE INVENTION

The present invention has been accomplished in view of the above circumstances, and an object of the present invention is to provide an electrode mounting structure of a surface treatment apparatus capable of preventing a spark from being generated at a threaded portion through which an electrode is detachably attached to an electrode holder member and capable of enhancing the maintenance performance of the electrode.

The above and other objects of the present invention can be achieved by providing an electrode mounting structure of a surface treatment apparatus comprising:

a metal electrode disposed so as to oppose to a surface of an object to be treated, the electrode and the object to be treated being energized in a state where a treatment liquid is interposed between the electrode and the surface of the object to be treated, and under the state, the surface of the object is pre-plated or plated;

an electrode holder member to which the metal electrode is detachably attached; and a resin coupler member formed with a threaded portion to be engaged with another threaded portion formed to at least one of the electrode holder member and the electrode to thereby attach the electrode to the electrode holder member.

In the above aspect, the following preferred embodiments may be adopted.

It may be desired that one of the electrode and the electrode holder member is formed with a convex portion, another one of the electrode and the electrode holder member is formed with a threaded portion, the coupler is formed with an engaging portion to be engaged with the convex portion, the threaded portion of the coupler member is engaged with the threaded portion of the electrode or the electrode holder member, and the engaging portion of the coupler member is engaged with the convex portion through a resilient member to thereby mount the electrode to the electrode holder member.

It may be desired that an energization portion of the electrode and the electrode holder member includes a flat contact surface of the electrode and the electrode holder member, or includes a conical contact surface of the electrode and the electrode holder member.

The coupler member and the electrode holder member may have the same outer diameter in a state where the electrode is attached to the electrode holder member by the coupler member.

It may be also desired that both the electrode and the electrode holder member are formed with threaded portions, and the coupler member has a threaded portion to be engaged with the threaded portions of both the electrode and the electrode holder member.

The surface treatment apparatus may be a circulation surface treatment apparatus in which the treatment liquid flows and circulates between the electrode and the surface of the object to be treated.

The surface treatment apparatus may be of an immersion surface treatment apparatus in which the electrode and the object to be treated are immersed in a treatment liquid tank in which the treatment liquid is accumulated, and the treatment liquid is interposed between the electrode and the surface to be treated of the object to be treated.

The object to be treated may be a cylinder of an engine, and the surface to be treated may be a cylinder inner-peripheral surface of the cylinder.

According to the present invention, the materials forming the threaded portions through which the electrode is detachably attached to the electrode holder member are not metals but are a combination of a metal and a resin. Therefore, it is possible to prevent a spark from being generated at the threaded portions, and as a result, adhesion of the threaded portion can be avoided, it becomes easy to detach the electrode and thus, the maintenance performance can be enhanced.

The nature and further characteristic features of the present invention will be made clearer from the following descriptions made with reference to the accompanying drawings.

DESCRIPTION OF THE PREFERRED EMBODIMENTS

The preferred embodiments of the present invention will be explained hereunder with reference to the accompanying drawings. It is to be noted that terms "upper", "lower", "right", "left" and the like terms are used herein with reference to the illustration of the drawings or in a usable state of an apparatus.

Figure 1:
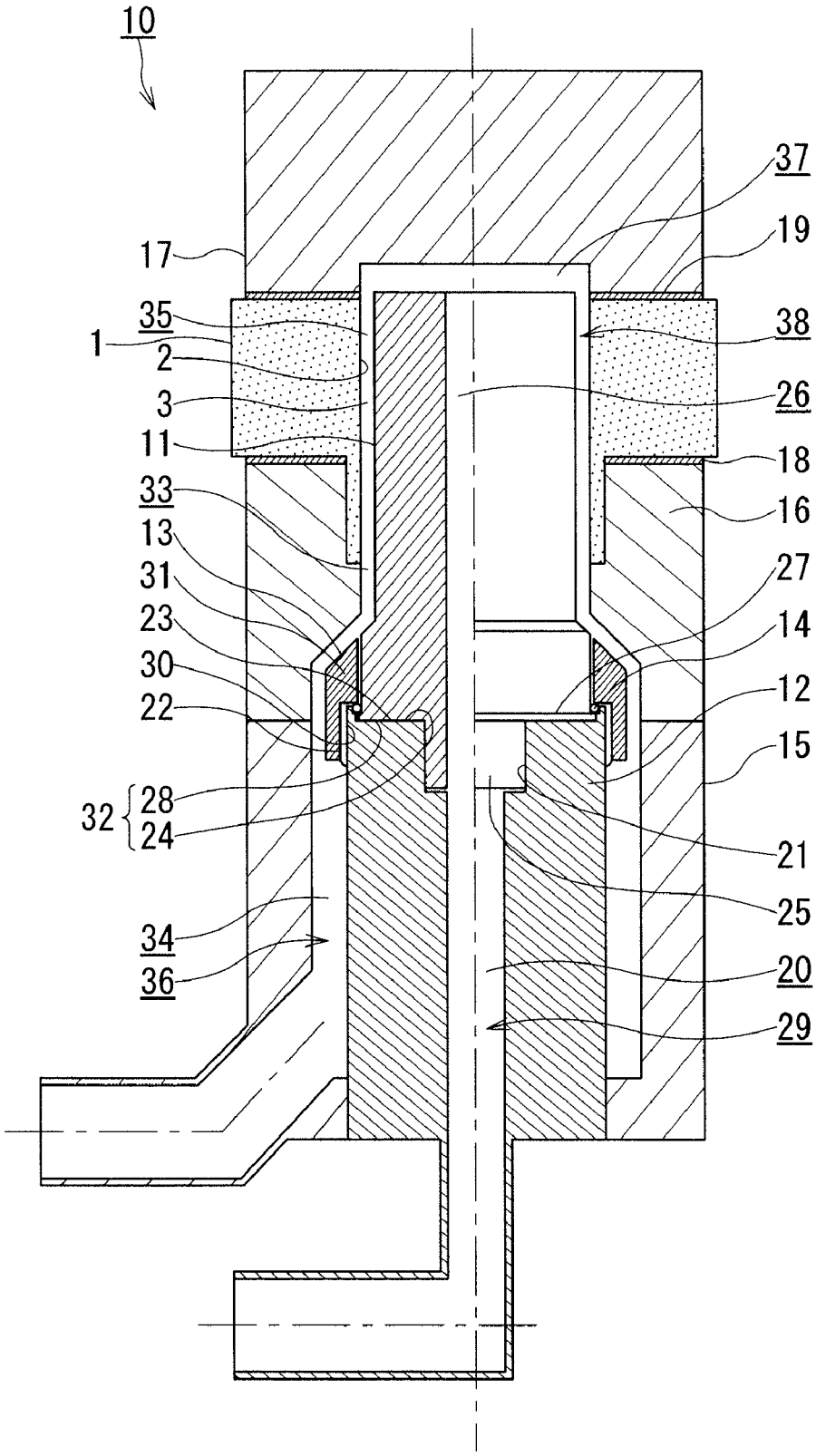
FIG. 1 is a side sectional view showing a plating apparatus to which an electrode mounting structure of a surface treatment apparatus according to a first embodiment of the present invention is applied.

First Embodiment (FIG. 1)

FIG. 1 represents an electrode mounting structure of a surface treatment apparatus according to the present invention is applied.

A plating apparatus 10 as a surface treatment apparatus is a circulation type plating apparatus. In the plating apparatus 10, an electrode 11 is disposed in opposition to a cylinder inner-peripheral surface 2 as a surface to be treated of a cylinder 1 as a object to be treated, treatment liquid (pre-plating liquid or plating liquid) flow and circulate between the electrode 11 and the cylinder inner-peripheral surface 2, and the electrode 11 and the cylinder 1 are energized in this state so as to perform pre-plating or plating process or treatment to the cylinder inner-peripheral surface 2.

The plating apparatus 10 includes, in addition to the electrode 11, an electrode holder member 12, a coupler member 13, an O-ring 14 as an elastic member, a fixture body 15, a lower fixture 16 and an upper fixture 17. It is necessary to periodically perform maintenance, such as cleaning, of the electrode 11 to renew a masking or to renew a special surface coating. Because of this reason, it is necessary to detachably mount the electrode 11 to the electrode holder member 12.

The fixture body 15 includes and fixes the electrode holder member 12, and the lower fixture 16 is placed on an upper end surface of the fixture body 15. The lower fixture 16 includes the electrode 11, and a silicon rubber lower seal member 18 is attached to an upper end surface of the lower fixture 16. The cylinder 1 is placed on the lower fixture 16 through the lower seal member 18. The upper fixture 17 is constructed to be vertically movable by an air-cylinder, and a silicon rubber upper seal member 19 is attached to a lower end of the upper fixture 17. The upper fixture 17 presses the cylinder 1 placed on the lower fixture 16 toward the lower fixture 16, and sandwiches the cylinder 1 between the upper fixture 17 and the lower fixture 16.

The electrode holder member 12 is made of metal such as SUS and titanium, an inner treatment liquid lower flow path 20 is formed at an axis position of the electrode holder member 12, and a fitting hole 21 is formed in an upper central position of the electrode holder member 12. A threaded portion 22 is formed in an upper outer periphery of the electrode holder member 12, and an upper end surface of the electrode holder member 12 is recessed and formed with a concave portion 23. A flat surface portion of the concave portion 23 constitutes a contact surface 24 which comes into contact with the electrode 11.

The electrode 11 is made of metal such as SUS and titanium, and a fitting projection 25 is formed on the center of a lower portion of the electrode 11. The fitting projection 25 is fitted into a fitting hole 21 of the electrode holder member 12 so as to position the electrode 11 with respect to the electrode holder member 12.

An inner treatment liquid upper flow path 26 is formed at an axis position of the electrode 11, for example, and the inner treatment liquid upper flow path 26 is communicated with an inner treatment liquid lower flow path 20 of the electrode holder member 12 to thereby form an inner treatment liquid flow path 29.

A convex portion 27 which swells radially outward is formed on a lower end of an outer periphery of the electrode 11. A lower end of the electrode 11 including the convex portion 27 is accommodated in a concave portion 23 of the electrode holder member 12. At that time, a lower end surface of the electrode 11 including the convex portion 27 forms a contact surface 28 which comes into contact with the contact surface 24 of the electrode holder member 12.

The coupler member 13 is made of glass fiber reinforced plastic such as heat-resistant and withstand voltage resin, e.g., UNILATE (registered trademark), and is formed into a ring-shape. A threaded portion 30 capable of threadedly engaging a threaded portion 22 of the electrode holder member 12 is formed on a lower portion of an inner periphery of the coupler member 13, and an engaging portion 31 is formed on an upper portion of the inner periphery of the coupler member 13. The engaging portion 31 is engaged with a convex portion 27 of the electrode 11 through an O-ring 14 in a state where the threaded portion 30 is engaged with the threaded portion 22 of the electrode holder member 12, and the engaging portion 31 pushes the convex portion 27 toward the electrode holder member 12 through the O-ring 14. Accordingly, the contact surface 28 of the electrode 11 comes into contact, under pressure, with the contact surface 24 of the electrode holder member 12 to thereby constitute an energizing portion 32. The electrode 11 is detachably attached to the electrode holder member 12 by means of the threaded portions 22 and 35.

An outer treatment liquid central flow path 33 is formed between the lower fixture 16, the electrode 11 and the coupler member 13 in a state where the electrode 11 is attached to the electrode holder member 12. The outer treatment liquid central flow path 33 is communicated with an outer treatment liquid lower flow path 34 formed between the fixture body 15 and the electrode holder member 12 and also communicated with an outer treatment liquid upper flow path 35 formed between the electrode 11 and the cylinder 1 interposed between the lower fixture 16 and the upper fixture 17, thus constituting an outer treatment liquid flow path 36.

The outer treatment liquid flow path 36 and the inner treatment liquid flow path 29 are brought into communication with each other through a communication flow path 37 between the electrode 11 and the upper fixture 17 to thereby constitute a treatment liquid flow path 38. Treatment liquid flows into the treatment liquid flow path 38, and the treatment liquid is circulated between the treatment liquid flow path 38 and a treatment liquid tank, not shown.

The electrode 11 is mounted to the electrode holder member 12 in a manner or process described hereunder.

The fitting projection 25 of the electrode 11 is inserted and fitted into the fitting hole 21 of the electrode holder member 12 in a state where the lower fixture 16 is detached from the fixture body 15 such that axes of the electrode 11 and the electrode holder member 12 coincide with each other. The contact surface 28 of the electrode 11 is brought into contact with the contact surface 24 of the electrode holder member 12.

Then, the O-ring 14 is inserted into the electrode 11 to a position in the convex portion 27 of the electrode 11. Thereafter, the coupler member 13 is inserted into the electrode 11, and the threaded portion 30 of the coupler member 13 is threadedly engaged with the threaded portion 22 of the electrode holder member 12. With such engaged state, the convex portion 27 of the electrode 11 is pushed toward the electrode holder member 12 through the O-ring 14 by the engagement of the engaging portion 31 of the coupler member 13, and the contact surface 28 of the electrode 11 is brought into pressure contact with the contact surface 24 of the electrode holder member 12. According to this manner, the attaching operation of the electrode 11 is completed.

Next, the cylinder 1 is mounted to the plating apparatus 10 in a manner or process described hereunder.

After the electrode 11 is attached to the electrode holder member 12, the lower fixture 16 is placed on the fixture body 15, and the cylinder 1 is placed on the lower seal member 18 located on the lower fixture 16. The upper fixture 17 is lowered by the operation of an air cylinder, not shown, the upper seal member 19 on a lower surface of the upper fixture 17 is brought into abutment against the cylinder 1, and the cylinder 1 is sandwiched between the lower fixture 16 and the upper fixture 17 through the lower seal member 18 and the upper seal member 19, respectively, with the sealing performance being secured. At this time, the electrode 11 is in a position inserted into the lower fixture 16 and the cylinder 1 and opposing to the cylinder inner-peripheral surface 2 of the cylinder 1.

Hereunder, the pre-plating and plating processes or treatments will be explained.

In a state where the cylinder 1 is attached to the plating apparatus 10, a pump, not shown, is actuated to supply the treatment liquid (i.e., pre-plating liquid) to the treatment liquid flow path 38 (inner treatment liquid flow path 29 and outer treatment liquid flow path 36) so as to circulate the path. When the cylinder bore 3 of the cylinder 1 surrounded by the cylinder inner-peripheral surface 2 is filled with the treatment liquid, the electrode 11 and the cylinder 1 are energized, by a power supply device, not shown, so that the cylinder 1 becomes a positive pole and the electrode 11 becomes a negative pole. The cylinder inner-peripheral surface 2 is electrolytically etched as pre-plating process, and the adhesiveness of plating can be enhanced.

In the plating process, the same plating apparatus 10 as that in the pre-plating process is used, the pre-plated cylinder 1 is attached to the plating apparatus 10 in the same manner as that in the pre-plating process, and the plating is then performed. In the plating process, however, the electrode 11 and the cylinder 1 is energized so that the electrode 11 becomes a positive pole and the cylinder 1 becomes a negative pole. According to this energization, the cylinder inner-peripheral surface 2 of the cylinder 1 is plated. The cylinder 1 is then immersed in a degreasing tank in which chemical is accumulated before the pre-plating process to thereby degrease and remove oil and contamination adhering to the cylinder 1.

In an experiment, one hundred cylinders (cylinders 1 with plating films) were prepared by performing degreasing, the pre-plating and the plating processes successively performed as described above. Then, the electrode 11 was detached from the electrode holder member 12, and whether the electrode 11 was adhered to the electrode holder member 12 was checked.

Figure 7:
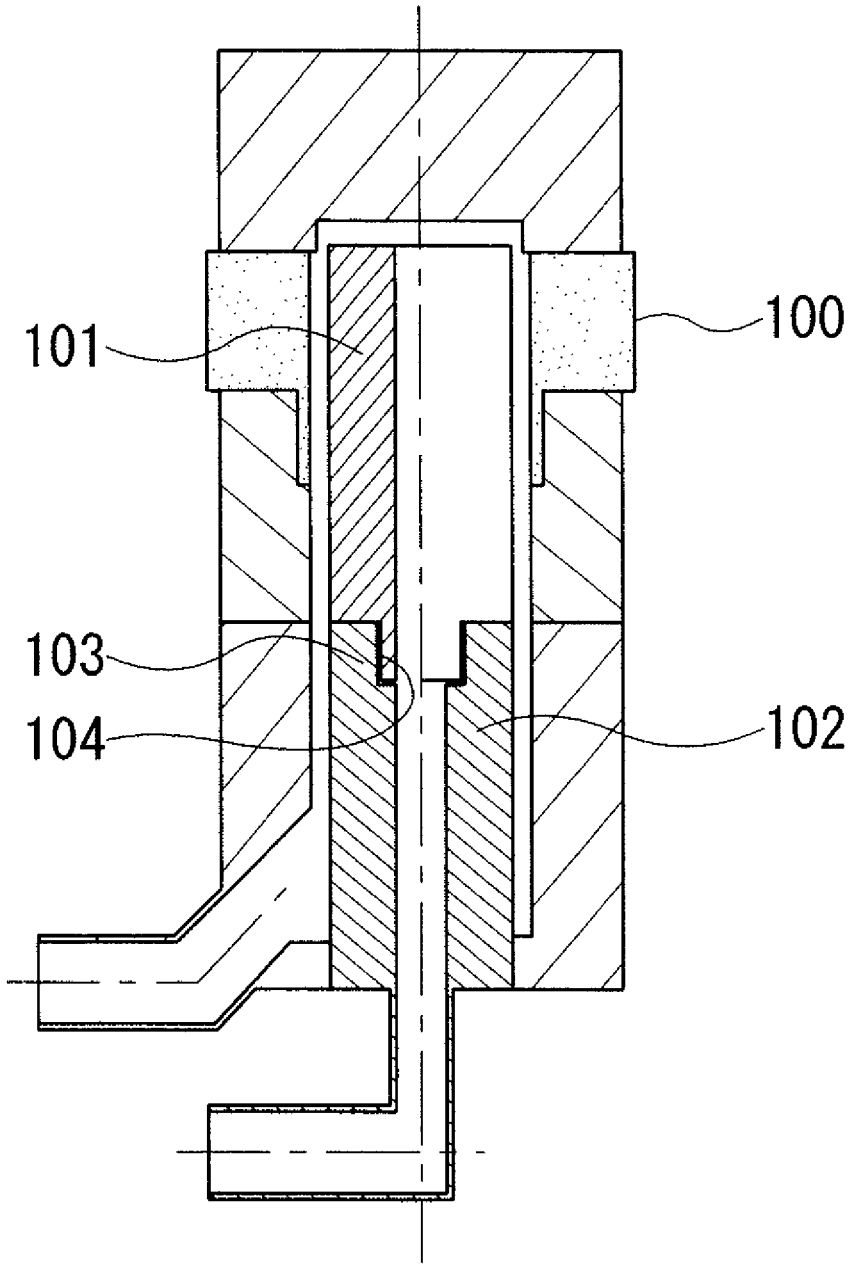
FIG. 7 PRIOR ART
FIG. 7 is a side sectional view showing a structure of a conventional plating apparatus.
Figure 8:
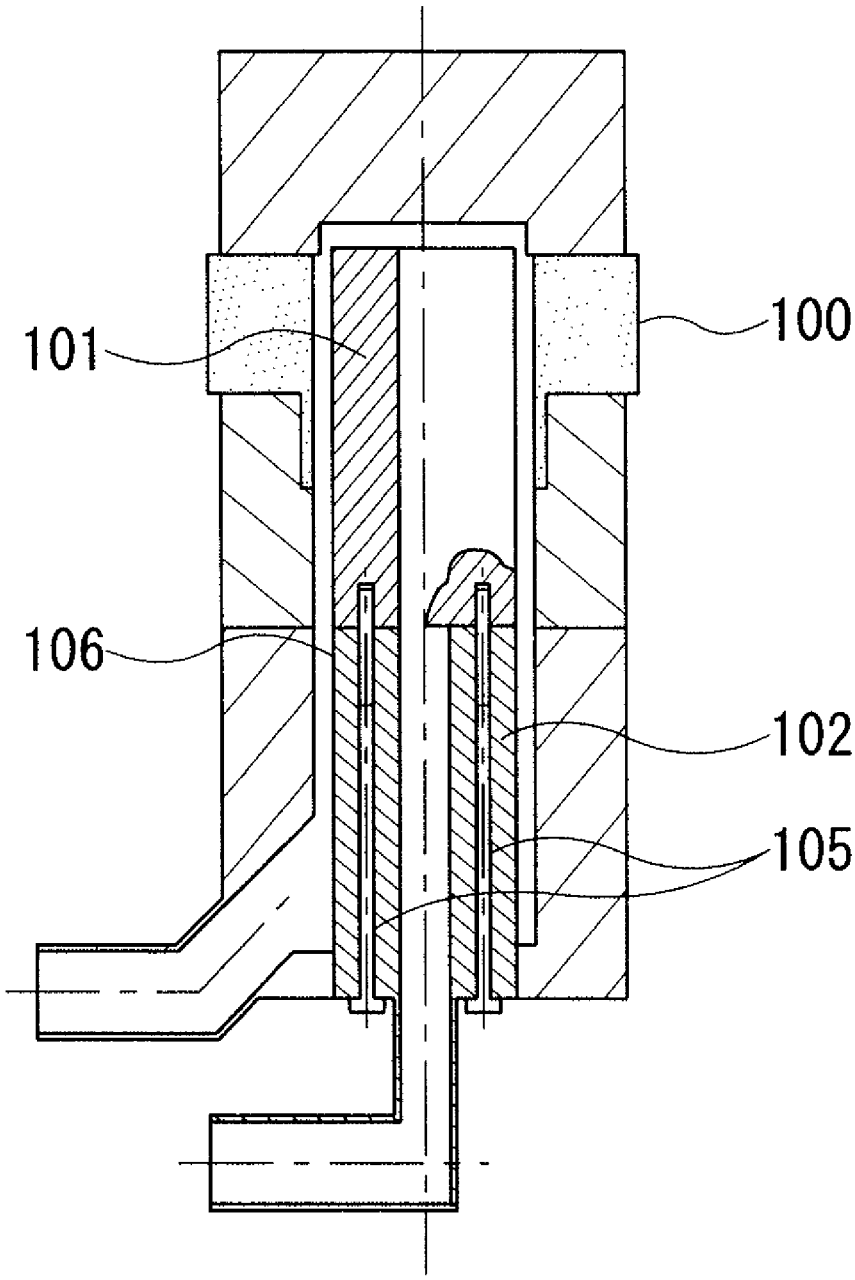
FIG. 8 PRIOR ART
FIG. 8 is a side sectional view showing a structure of another conventional plating apparatus.

For this experiment, as shown in FIG. 7, the same experiment was performed with respect to the conventional mounting structure in which an electrode 101 and an electrode holder member 102, both made of metal, were directly threadedly engaged with each other through the threaded portions 103 and 104, and it was checked whether the electrode 101 was adhered to the electrode holder member 102.

In the electrode mounting structure used in this experiment, as shown in Table 1, the electrode mounting structure "A" is of the present embodiment shown in FIG. 1, and the electrode mounting structure "B" is of the conventional technique shown in FIG. 7.

In the electrode mounting structure "B", materials of both the threaded portion 103 (male threaded portion) formed on the electrode 101 and the threaded portion 104 (female threaded portion) formed in the electrode holder member 102 are metal (SUS or titanium).

On the other hand, in the electrode mounting structure "A", material of the threaded portion 22 (male threaded portion) formed on the electrode holder member 12 is metal (SUS or titanium), and material of the threaded portion 30 formed on the coupler member 13 is resin (e.g., UNILATE).

TABLE 1

| | | Material of threaded portion | | |
|---|---|---|---|---|
| | Electrode mounting structure | Male threaded portion | Female threaded portion | Reference drawing |
| A | Structure "A" | Metal (SUS, titanium) | Resin (UNILATE) | FIG. 1 |
| B | Structure "B" | Metal (SUS, titanium) | Metal (SUS, titanium) | FIG. 7 |

(wherein:
Structure "A" in which electrode is attached to electrode holder member using resin coupler member provided with threaded portion.
Structure "B" in which both threaded portions provided on electrode and electrode holder member are threadedly engaged with each other to attach the electrode to the electrode holder member.)

In the degreasing process, chemical accumulated in the degreasing tank, in which the cylinder 1 is immersed, is MAXCLEEN NG30 (TradeMark) produced by Kizai Corporation, liquid temperature of the chemical is 50° C., and immersing time of the cylinder 1 is 1.5 minutes.

In the electrolytic etching in the pre-plating process, the treatment liquid which flows to the treatment liquid flow path 38 is phosphoric acid liquid, and its liquid temperature is 85° C. Current density supplied to the electrode 11 and the cylinder 1 is 70 A/dm$^2$, and energizing time is 1.5 minutes.

In the plating process, the treatment liquid which flows to the treatment liquid flow path 38 is nickel sulfate liquid, and its liquid temperature is 65° C. Current density supplied to the electrode 11 and the cylinder 1 is 100 A/dm$^2$, and energizing time is 3 minutes.

After one hundred cylinders 1 were processed, the electrodes 11 and 101 were detached from the electrode holder members 12 and 102, respectively, in the plating apparatus which performed the pre-plating process, and the plating apparatus which performed the plating process, and it was checked whether the adhesion occurred at the threaded portions 22, 30, 103 and 104 and at portions other than the threaded portions. A result is shown in Table 2.

In the electrode mounting structure "A", the electrode 11 could smoothly be detached after the pre-plating (electrolytic etching) and plating processes. In the electrode mounting structure "B", the threaded portions 103 and 104 were forcibly loosened while spending time and the electrode 101 was detached after the pre-plating (electrolytic etching) process and after the plating process. In this case, it was necessary to form threads on both the threaded portions 103 and 104 of the electrode 101 and the electrode holder member 102 using tap and dies.

TABLE 2

| | Adhesion in electrolytic etching | | Adhesion in plating | |
|---|---|---|---|---|
| Electrode mounting structure | Threaded portion | Other than threaded portion | Threaded portion | Other than threaded portion |
| A | Absence | Absence | Absence | Absence |
| B | Presence | Absence | Presence | Absence |

Therefore, according to the present embodiment, the following effects (1) to (4) are obtained.

(1) The threaded portion 30 of the resin coupler member 13 is threadedly engaged with the threaded portion 22 of the electrode holder member 12, and the electrode 11 is attached to the electrode holder member 12. Therefore, the materials of the threaded portions 22 and 30, by which the electrode 11 is detachably attached to the electrode holder member 12, are not both metals, but a combination of metal and resin is utilized. Thus, it is possible to prevent a spark from being generated in the threaded portions 22 and 30, and as a result, adhesion of the threaded portions 22 and 30 can be avoided. The electrode 11 can be easily detached, and the maintenance performance of the electrode 11 can be enhanced.

Since it is possible to prevent a spark from being generated in the threaded portions 22 and 30, the electrode 11 and the cylinder 1 can be energized with large current, and the processing time of the pre-plating and plating of the cylinder 1 can be shortened.

(2) The threaded portion 30 of the resin coupler member 13 is threadedly engaged with the threaded portion 22 of the metal electrode holder member 12, the engaging portion 31 of the coupler member 13 is engaged with the convex portion 27 of the electrode 11 through the O-ring 14 and pushes the convex portion 27, and the electrode 11 is attached to the electrode holder member 12. Since the O-ring 14 is interposed therebetween, and an impact can be absorbed, it is possible to prevent the coupler member 13 from being damaged.

(3) The O-ring 14 is interposed between the convex portion 27 of the electrode 11 and the engaging portion 31 of the coupler member 13, and the O-ring 14 is expanded by the treatment liquid which is heated during the pre-plating or plating process (e.g., 50° C. or higher). Therefore, even if the coupling between the threaded portions 22 and 30 of the electrode holder member 12 and the coupler member 13 having different coefficients of thermal expansion is loosened during the pre-plating or plating process, since the expansion of the O-ring 14 increases the pushing force pushing the electrode 11 against the electrode holder member 12, the looseness between the threaded portions 22 and 30 can be cancelled, and the electrode 11 can be firmly attached to the electrode holder member 12. At the same time, the contact surface 28 of the electrode 11 and the contact surface 24 of the electrode holder member 12 come into contact with each other uniformly, and the energization can be performed smoothly.

(4) The energizing portion 32 between the electrode 11 and the electrode holder member 12 is constituted through the pressure contact between the flat contact surface 28 of the electrode 11 and the flat contact surface 24 of the electrode holder member 12, the threaded portion 22 of the electrode holder member 12 is formed on the outer peripheral surface of the electrode holder member 12, and a through hole for the threaded portion is not formed in the energizing portion 32. Therefore, the contact surface area of the energizing portion 32 can be increased, and the energization can be excellently performed. Even if the adhesion is generated on the energizing portion 32 by a spark, since this spark is one generated at a portion other than the threaded portions 22 and 30, the electrode 11 can be moved perpendicularly to the electrode holder member 12 by loosening the coupler member 13. As a result, the electrode 11 can easily be detached.

In this embodiment, the electrode 11 is formed with the convex portion 27 which is engaged with the engaging portion 31 of the coupler member 13, and the electrode holder member 12 is formed with the threaded portion 22 which is engaged with the threaded portion 30 of the coupler member 13. However, the electrode holder member 12 may be formed with the convex portion 27 and the electrode 11 may be formed with the threaded portion 22.

Figure 2:
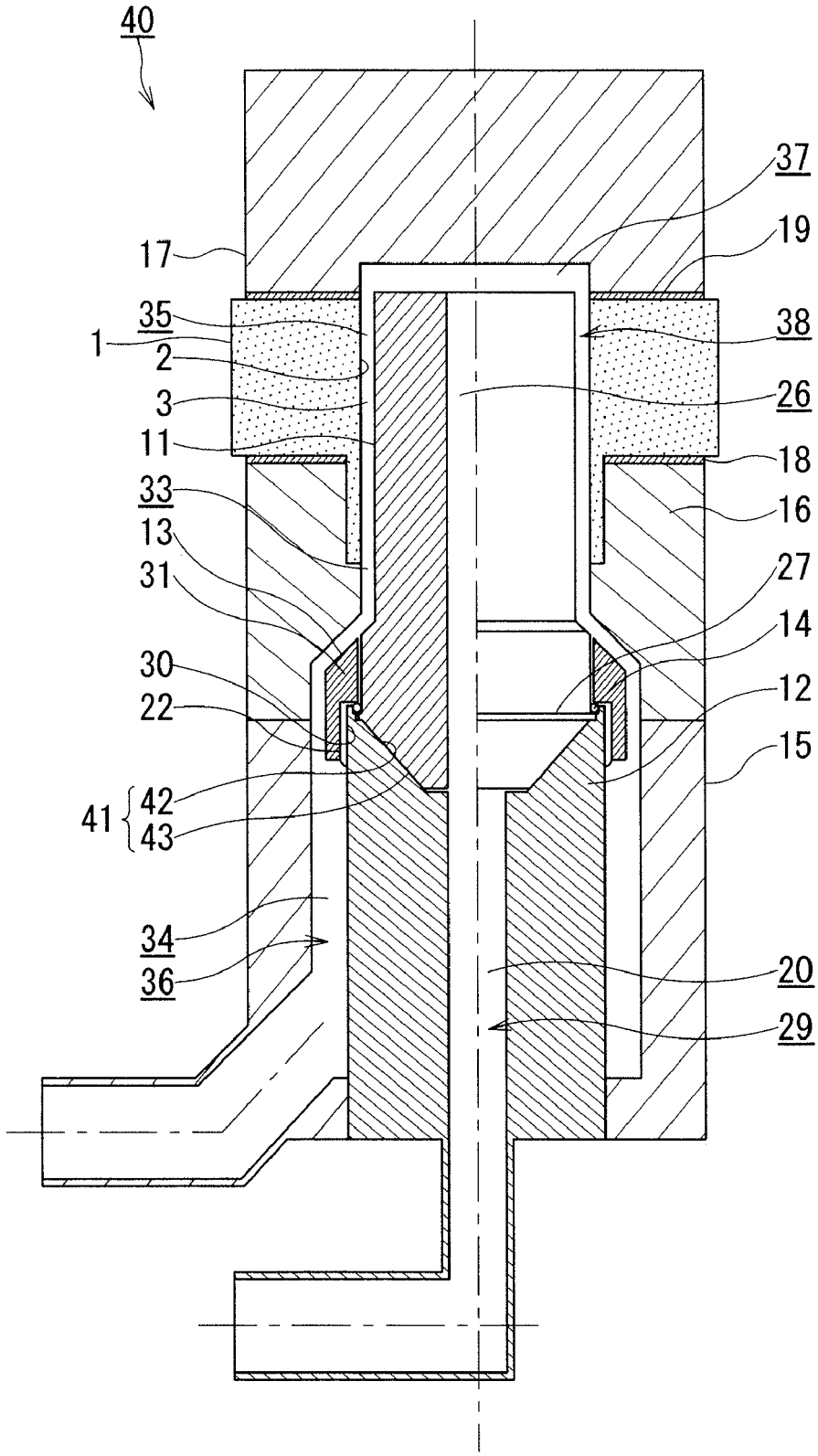
FIG. 2 is a side sectional view showing a plating apparatus to which an electrode mounting structure of the surface treatment apparatus according to a second embodiment of the present invention is applied.

Second Embodiment (FIG. 2)

FIG. 2 represents a plating apparatus to which a second embodiment of the electrode mounting structure of the surface treatment apparatus according to the present invention is applied. In the second embodiment, like reference numerals are added to members or portions corresponding to those of the first embodiment, and duplicated explanation thereof will be simplified or omitted herein.

A plating apparatus 40 of the second embodiment is different from the plating apparatus 10 of the first embodiment in the structure of an energizing portion 41 of the electrode 11 and the electrode holder member 12.

A conical contact surface 42 provided with a tapered portion is formed on an upper end surface of the electrode holder member 12, and a conical contact surface 43 provided with a tapered portion is formed on a lower end surface of the electrode 11. These contact surfaces 42 and 43 come into contact with each other, thereby forming the energizing portion 41 of the electrode 11 and the electrode holder member 12.

Therefore, according to this embodiment, the following effect (5) can be obtained in addition to the effects (1) to (4) attained by the first embodiment.

(5) Since the energizing portion 41 of the electrode 11 and the electrode holder member 12 is constituted by the conical contact surfaces 43 and 42 of the electrode 11 and the electrode holder member 12, the contact surfaces of the contact surfaces 43 and 42 can be increased, and the axis of the electrode 11 coincides with the axis of the electrode holder member 12 by fastening the coupler member 13.

Figure 3:
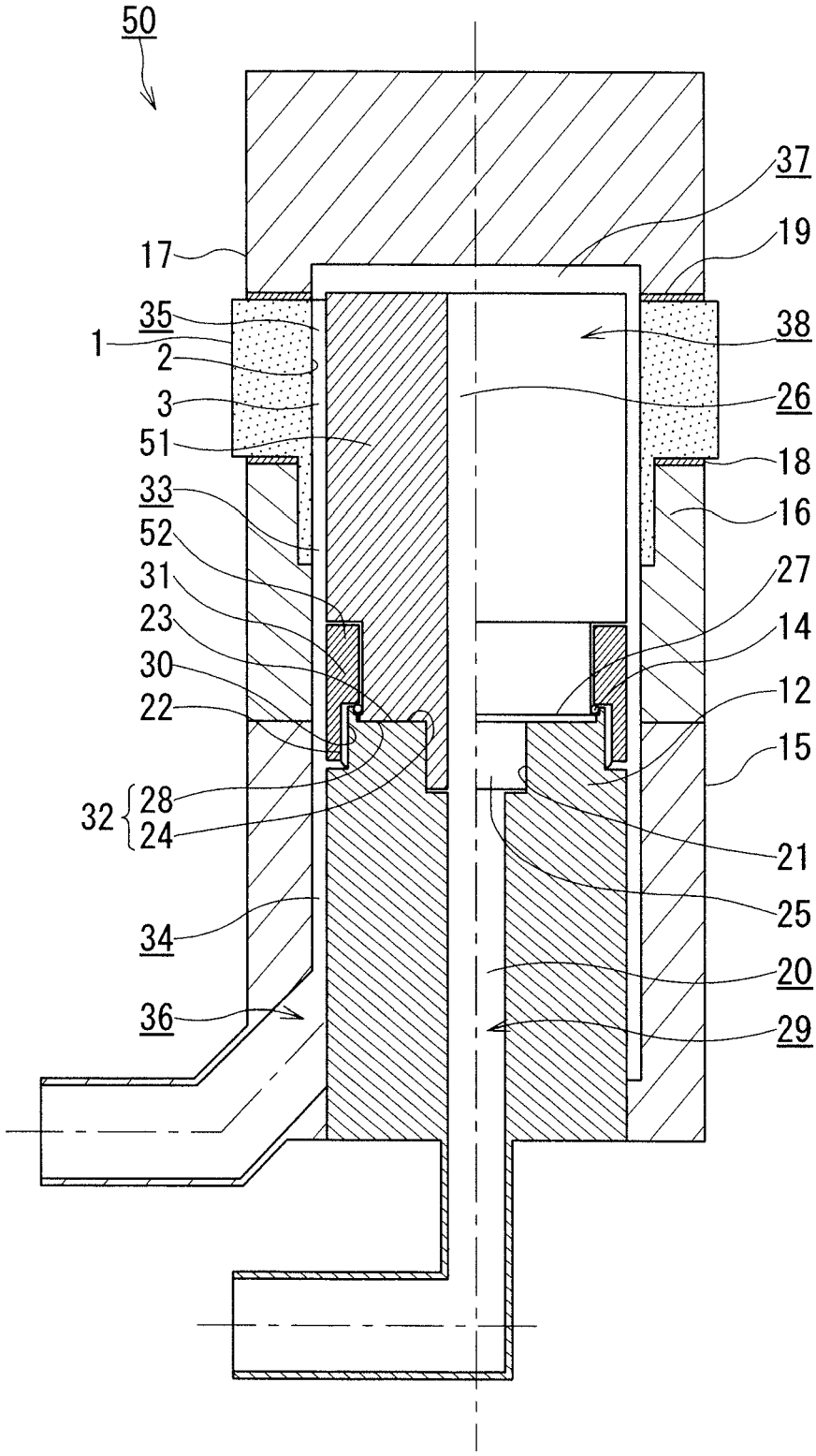
FIG. 3 is a side sectional view showing a plating apparatus to which an electrode mounting structure of the surface treatment apparatus according to a third embodiment of the present invention is applied.

Third Embodiment (FIG. 3)

FIG. 3 represents a plating apparatus to which a third embodiment of the electrode mounting structure of the surface treatment apparatus according to the present invention is applied. In the third embodiment, like reference numerals are added to members or portions corresponding to those of the first embodiment, and duplicated explanation thereof will be simplified or omitted herein.

A plating apparatus 50 of the third embodiment is different from the plating apparatus 10 of the first embodiment in that outer diameters of an electrode 51, a coupler member 52 and the electrode holder member 12 are the same in a state where the electrode 51 is attached to the electrode holder member 12 using the coupler member 52.

Therefore, according to this embodiment, the following effect (6) can be obtained in addition to the effects (1) to (4) of the first embodiment.

(6) In the state where the electrode 51 is attached to the electrode holder member 12 using the coupler member 52, the outer diameters of the electrode 51, the coupler member 52 and the electrode holder member 12 are the same. Therefore, any portion in a mindering shape of flow does not exist in the outer treatment liquid flow path 36 through which treatment liquid flows, and the treatment liquid can smoothly flow in the outer treatment liquid flow path 36.

Figure 4:
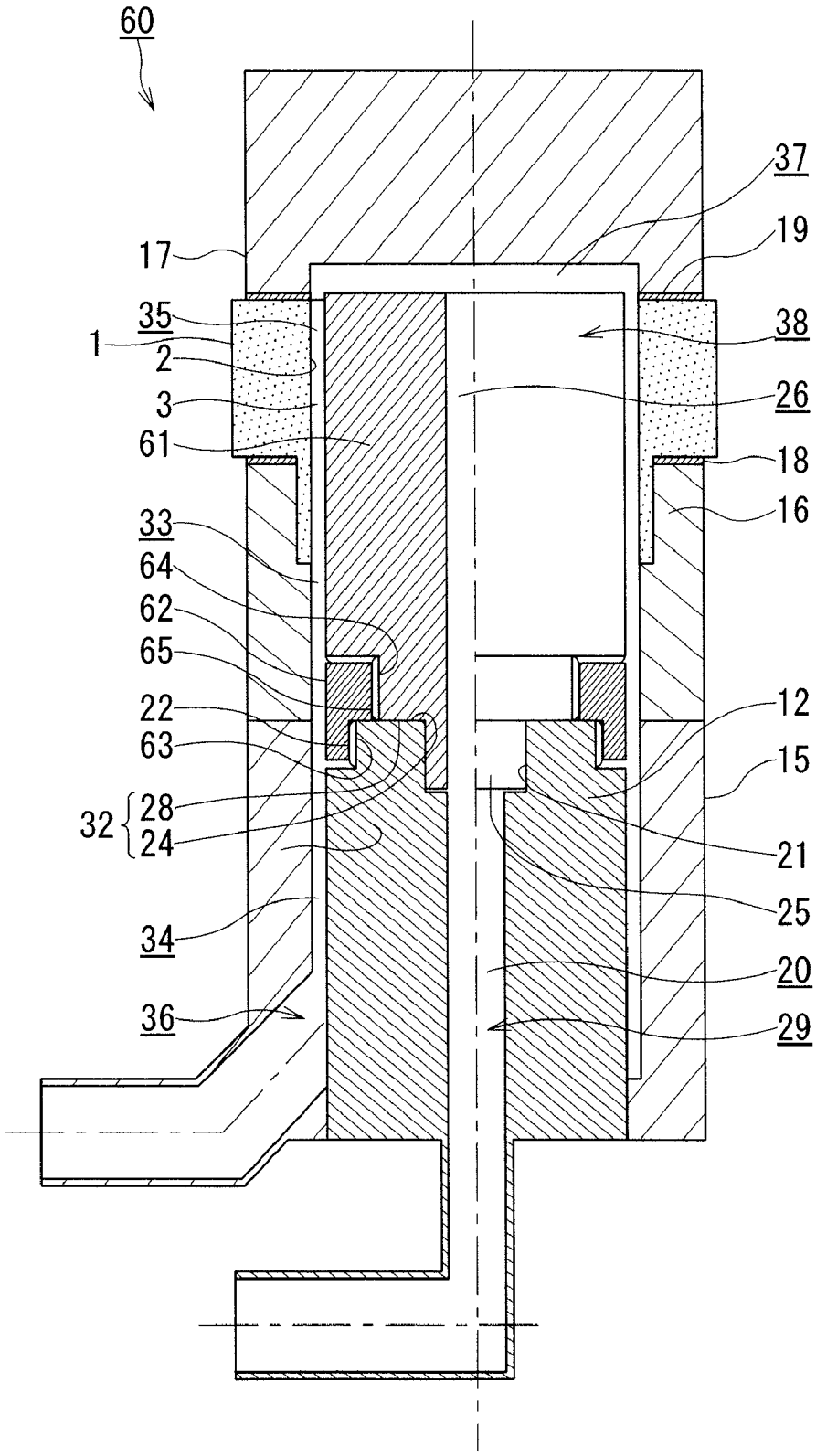
FIG. 4 is a side sectional view showing a plating apparatus to which an electrode mounting structure of the surface treatment apparatus according to a fourth embodiment of the present invention is applied.

Fourth Embodiment (FIG. 4)

FIG. 4 represents a plating apparatus to which a fourth embodiment of the electrode mounting structure of the surface treatment apparatus according to the present invention is applied. In the fourth embodiment, like reference numerals are added to members or portions corresponding to those of the first embodiment, and duplicated explanation thereof will be simplified or omitted herein.

A plating apparatus 60 of the fourth embodiment is different from the plating apparatus 50 of the third embodiment in that both electrode 61 and electrode holder member 12 are formed with threaded portions, and a coupler member 62 is provided with threaded portions, which are engaged respectively with the threaded portion of the electrode 61 and with the threaded portion of the electrode holder member 12.

A threaded portion 63 capable of engaging the threaded portion 22 of the metal electrode holder member 12 is formed on a lower portion of an inner periphery of a resin coupler member 62. A threaded portion 64 is formed on an upper portion of the inner periphery of the coupler member 62, and the threaded portion 64 can be engaged with a threaded portion 65 formed on a lower portion of an outer periphery of a metal electrode 61. The threaded portions 22 and 63 and the threaded portions 64 and 65 are formed with threads extending in the same direction.

When the electrode 61 is mounted to the electrode holder member 12, the threaded portion 63 of the coupler member 62 is threadedly engaged with the threaded portion 22 of the electrode holder member 12, and the coupler member 62 is attached to the electrode holder member 12. Thereafter, the threaded portion 65 of the electrode 61 is engaged with the threaded portion 64 of the coupler member 62, and the electrode 61 is attached to the coupler member 62. Thus, the electrode 61 is mounted to the electrode holder member 12 through the coupler member 62.

Therefore, according to this embodiment, the following effect (7) can be obtained in addition to the effects (1) to (4) and (6) of the first and third embodiments.

(7) The electrode holder member 12 and the electrode 61 are formed with the threaded portions 22 and 65, respectively, and the threaded portions 63 and 64 which can be engaged with the threaded portions 62 and 65, respectively, are formed on the coupler member 62. Therefore, it is not necessary to locate the O-ring 14. As a result, the attaching operation of the electrode 61 can be simplified.

Figure 5:
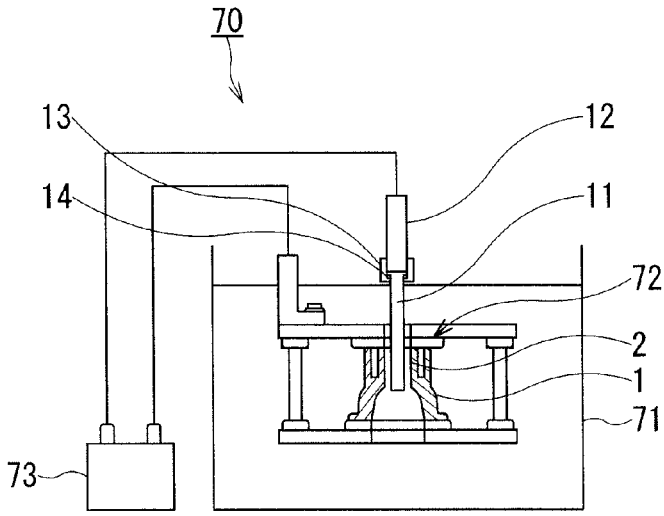
FIG. 5 is a side sectional view showing a plating apparatus to which an electrode mounting structure of the surface treatment apparatus according to a fifth embodiment of the present invention is applied.
Figure 6:
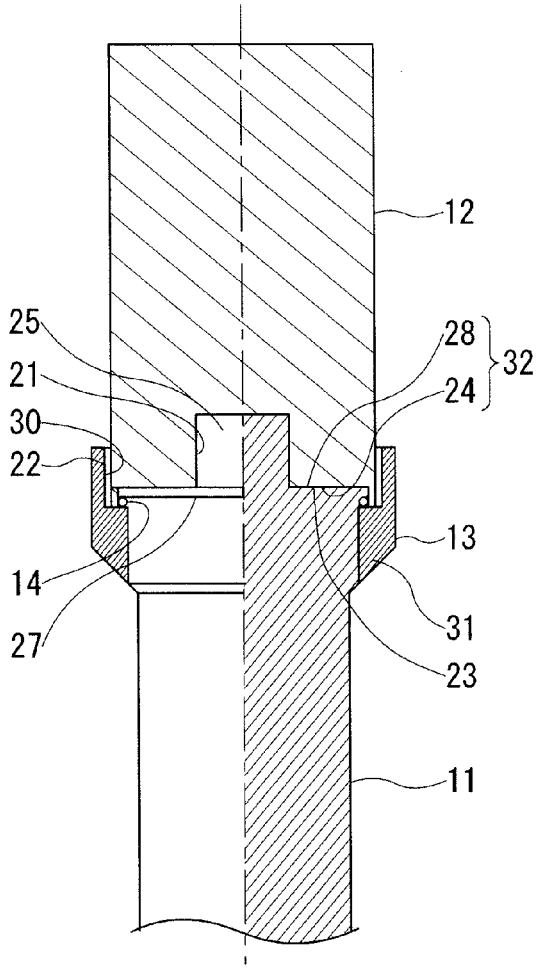
FIG. 6 is a side sectional view showing an electrode and an electrode holder member shown in FIG. 5.

Fifth Embodiment (FIGS. 5 and 6)

FIG. 5 represents a plating apparatus to which a fifth embodiment of the electrode mounting structure of the surface treatment apparatus according to the present invention is applied. In the fifth embodiment, like reference numerals are added to members or portions corresponding to those of the first embodiment, and duplicated explanation thereof will be simplified or omitted herein.

A plating apparatus 70 of the fifth embodiment is different from the plating apparatus 10 of the first embodiment in that the plating apparatus is of an immersion-type apparatus in which in a state where the electrode 11 is opposed to the cylinder inner-peripheral surface 2 of the cylinder 1, the cylinder 1 and the electrode 11 are immersed in a treatment liquid tank 71 filled with the treatment liquid so as to interpose the treatment liquid between the electrode 11 and the cylinder inner-peripheral surface 2 of the cylinder 1. In this state, the electrode 11 and the cylinder 1 are energized, and the pre-plating or plating process is performed.

In this case, the threaded portion 30 of the resin coupler member 13 is threadedly engaged with the threaded portion 22 of the metal electrode holder member 12, the convex portion 27 of the electrode 11 is pushed against the electrode holder member 12 through the O-ring 14, and the electrode 11 is detachably mounted to the electrode holder member 12. As a result, the same effects as the effects (1) to (4) of the first embodiment are obtained.

A fixing fixture 72 in FIG. 5 is used for fixing the cylinder 1, and a power supply unit 73 is used for energizing the cylinder 1 and the electrode 11.

It is to be noted that the present invention is not limited to the described embodiments and many other changes and modifications may be made without departing from the scopes of the appended claims.

For example, the present invention may also be applied to a case where an object to be treated is a cylinder head integrated cylinder block including a cylinder and a crankcase.

What is claimed is:

1. An electrode mounting structure of a surface treatment apparatus comprising:

a metal electrode disposed so as to oppose a surface of an object to be treated, the electrode and the object to be treated being energized in a state where a treatment liquid is interposed between the electrode and the surface of the object to be treated, and under that state, the surface of the object is pre-plated or plated;

an electrode holder member to which the metal electrode is detachably attached; and a resin coupler member formed with a threaded portion to be engaged with another threaded portion formed to at least one of the electrode holder member and the electrode to thereby attach the electrode to the electrode holder member, wherein the coupler member and the electrode holder member have the same outer diameter in a state where the electrode is attached to the electrode holder member by the coupler member.

2. The electrode mounting structure of claim 1, wherein one of the electrode and the electrode holder member is formed with a convex portion, another one of the electrode and the electrode holder member is formed with a threaded portion, the coupler is formed with an engaging portion to be engaged with the convex portion, the threaded portion of the coupler member is engaged with the threaded portion of the electrode or the electrode holder member, and the engaging portion of the coupler member is engaged with the convex portion through a resilient member to thereby mount the electrode to the electrode holder member.

3. The electrode mounting structure of claim 1, wherein an energization portion of the electrode and the electrode holder member includes a flat contact surface of the electrode and the electrode holder member.

4. The electrode mounting structure of claim 1, wherein an energization portion of the electrode and the electrode holder member includes a conical contact surface of the electrode and the electrode holder member.

5. The electrode mounting structure of claim 1, wherein both the electrode and the electrode holder member are formed with threaded portions, and the coupler member has a threaded portion to be engaged with the threaded portions of both the electrode and the electrode holder member.

6. A surface treatment apparatus including the electrode mounting structure of claim 1, wherein the surface treatment apparatus is a circulation surface treatment apparatus, and the apparatus further comprises treatment liquid flows and circulates between the electrode and the surface of the object to be treated.

7. A surface treatment apparatus including the electrode mounting structure of claim 1, wherein the surface treatment apparatus is of an immersion surface treatment apparatus, and the apparatus further comprises treatment liquid accumulated in a treatment liquid tank in which the electrode and the object to be treated are immersed, wherein the treatment liquid is interposed between the electrode and the surface to be treated of the object to be treated.

8. A surface treatment apparatus including the electrode mounting structure of claim 1, wherein the object to be treated is a cylinder of an engine, and the surface to be treated is a cylinder inner-peripheral surface of the cylinder.

* * * * *